US007073399B2

(12) United States Patent
Josefsson

(10) Patent No.: US 7,073,399 B2
(45) Date of Patent: Jul. 11, 2006

(54) YARN PROCESSING SYSTEM

(75) Inventor: Paer Josefsson, Boras (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 10/494,401

(22) PCT Filed: Oct. 25, 2002

(86) PCT No.: PCT/EP02/11954

§ 371 (c)(1),
(2), (4) Date: Nov. 1, 2004

(87) PCT Pub. No.: WO03/038171

PCT Pub. Date: May 8, 2003

(65) Prior Publication Data

US 2005/0061388 A1 Mar. 24, 2005

(30) Foreign Application Priority Data

Oct. 29, 2001 (DE) ..... 101 53 326

(51) Int. Cl.
*G01L 1/04* (2006.01)
*G01L 5/04* (2006.01)
*D03D 41/00* (2006.01)

(52) U.S. Cl. ..... 73/862.451; 73/160; 139/194

(58) Field of Classification Search ..... 73/862, 73/862.381, 862.451, 862.474, 160
See application file for complete search history.

(56) References Cited

U.S. PATENT DOCUMENTS

| | | | | |
|---|---|---|---|---|
| 4,204,394 | A * | 5/1980 | Luthi | 57/334 |
| 5,050,648 | A | 9/1991 | Pezzoli | |
| 5,221,059 | A * | 6/1993 | Coons et al. | 242/147 R |
| 5,462,094 | A | 10/1995 | Josefsson et al. | |
| 5,476,122 | A | 12/1995 | Schuster et al. | |
| 5,844,494 | A * | 12/1998 | Spahlinger et al. | 340/677 |
| 6,418,977 | B1 | 7/2002 | Tholander | |
| 2004/0238060 | A1 * | 12/2004 | Hellstroem et al. | 139/2 |

FOREIGN PATENT DOCUMENTS

| | | |
|---|---|---|
| DE | 43 23 748 | 7/1994 |
| EP | 0 357 975 | 3/1990 |
| EP | 0 605 550 | 12/1995 |
| WO | WO 93/06278 | 4/1993 |
| WO | WO 00/37721 | 6/2000 |

* cited by examiner

*Primary Examiner*—Edward Lefkowitz
*Assistant Examiner*—George P. Bonanto
(74) *Attorney, Agent, or Firm*—Flynn, Thiel, Boutell & Tanis, P.C.

(57) ABSTRACT

The invention relates to a yarn processing system, comprising a yarn feeder (F), a textile machine (M), at least one controlled yarn brake (B) and a tensiometer, which senses the yarn downstream of said yarn brake, for at least measuring the yarn tension (g). According to said invention, the tensiometer (T) is permanently arranged within the yarn path, can be adjusted between a passive position (I) and at least one deflection position (II, III) and can be readjusted from said detection position (II, III) to the passive position (I) after a number of weft cycles, which number suffices to represent at least the proper adjustment of a yarn tension target profile.

9 Claims, 1 Drawing Sheet

YARN PROCESSING SYSTEM

FIELD OF THE INVENTION

The invention relates to a yarn processing system allowing high insertion speeds for different yarn qualities.

BACKGROUND OF THE INVENTION

The yarn tension target profile for the insertion cycles has to be adjusted during the first setting-up or after a changeover of the yarn processing system to another yarn quality (style change). A yarn tension target profile is selected which guarantees optimal insertion frequency and insertion speed with a minimum number of yarn breakages for the respective yarn quality. The yarn tension is influenced by a plurality of parameters, e.g. the withdrawal tension from the yarn feeding device, the braking effect of the yarn brake, the type and function of the insertion device of the textile machine, the yarn quality, and the like.

Even characteristics of the yarn like the rubbing property, the diameter, the elasticity, or the density are decisive for the resulting yarn tension profile. Those parameters need certain adjustments e.g. at braking devices influencing the yarn tension. Deviations from the set yarn tension profile needing compensation may even sometimes occur during operation of the yarn processing system, e.g. caused by different diameters of the supply bobbins, fluctuating yarn characteristics and differently spooled supply bobbins. The textile machine ought to process the yarn as quickly as possible for obvious reasons. In case of weak yarns the strength of the yarn sets a limit. If then the machine speed is raised beyond a critical limit the number of yarn breakages increases exponentially. The highest tension peaks caused by the high insertion speed may be reduced by means of a controlled yarn brake such that the tension remains close to lower values during particularly critical phases of the insertion. For this purpose high grade controllable and adjustable yarn brakes already exist. The precise setting of those yarn brakes is complicated such that they gained only limited positive influences on the processing efficiency in the yarn processing system in practice. Controlled yarn brakes can be adjusted optimally only with the information of the actual tension or the actual tension profile, respectively, during an insertion cycle. The information on the yarn tension can be obtained with the help of the tensiometer. The tensiometer, however, means an additional yarn friction angle during the measurement of the yarn tension. This additional friction angle, caused by the tensiometer, may mean a catastrophe for weak yarns, because the additional tension generated by the tensiometer increases the likelihood of yarn breakages dramatically such that the tensiometer cannot be used for a continuous operation of the yarn processing system with weak yarns. In the setting phase and until an optimal yarn tension target profile is adjusted this disadvantageous influence of the tensiometer on weak yarns, however, can be tolerated. Stronger yarns, which are processed with the help of a controlled yarn brake, to the contrary, can stand the detrimental influence of the tensiometer without an increase of the likelihood of yarn breakages even during constant operation.

It is known to employ a portable tensiometer which is put in the yarn path, measures the yarn tension, and, in some cases, shows the yarn tension on a laptop. The tensiometer is used for a number of insertion cycles which is representative of the adjustment of the yarn tension target profile, in order to adjust e.g. the withdrawal tension at the yarn feeding device, the braking level or timing of the yarn brake, and the like. During this adjustment phase yarn breakages or other disturbances may occur to a certain extent, until finally the optimal yarn tension target profile is found and established.

A yarn processing system known from EP 0 357 975A (corresponding to U.S. Pat. No. 5,050,648) employs a controlled yarn brake which is operated with the help of a tensiometer which is placed permanently in the yarn path. The tensiometer, permanently operating in its detection position would allow to adjust an optimal yarn tension target profile, however, the influence of the tensiometer is a drawback for weak yarn qualities because of the additional yarn deflection and yarn friction.

EP 0 605 550 A (corresponding to U.S. Pat. No. 5,462,094) discloses a yarn processing system having a tensiometer which is permanently associated to a controlled yarn brake and which is adjustable between a passive position and a detection position. Since the tensiometer is adjusted to the detection position only temporarily during each insertion cycle, namely when simultaneously the yarn brake is operating, no information on the yarn tension is available when the yarn brake does not brake. So to speak, the tensiometer only is able to measure a restricted section of the yarn tension profile during an insertion cycle. For an adjustment of an optimal yarn tension target profile, however, both the development and the course of the yarn tension during the entire insertion cycle are needed.

It is an object of the invention to provide a yarn processing system as disclosed at the beginning which allows high insertion speeds for different yarn qualities and with a minimal yarn breakage quota only.

Said object can be achieved by a yarn processing system comprising at least one yarn feeding device associated to a yarn channel, a textile machine like a weaving machine or a knitting machine, a yarn brake in the yarn path between the yarn feeding device and the textile machine, which yarn brake at least is adjustable, and a tensiometer at least for measuring the yarn tension, which tensiometer scans the yarn downstream of the yarn brake, which tensiometer is provided permanently in the yarn path and is switchable between a passive position and at least one detection position, and which tensiometer can be selectively switched from the respective detection position into the passive position after a number of insertion cycles has occurred which number is representative at least for the adjustment of a yarn tension target profile.

As soon as the tensiometer is switched over to the detection position, the tensiometer monitors the development and the course of the yarn tension during the entire insertion cycle. The tensiometer remains in the detection position for a representative number of insertion cycles, typically for about 50 to 100 insertion cycles, until the optimal yarn tension target profile is adjusted by varying the parameters influencing the yarn tension. The optimal yarn tension target profile is a target profile which assures a minimum number of yarn breakages in case of optimal high insertion speeds. In case of strong yarn qualities the tensiometer may remain in the detection position after the adjustment, in order further on to provide permanent information on the yarn tension, because strong yarn qualities can stand the additional friction caused by the tensiometer. However, as the tensiometer selectively can be readjusted to the passive position, an optimal yarn tension target profile can be adjusted even for weak yarn qualities, in some cases first with disturbances caused by the tensiometer. The finally found yarn tension target profile guarantees a minimal yarn breakage quota for an optimal high insertion speed, however, and after the tensiometer has been switched back to the passive position. The short period of time during which the weak yarn has to stand the additional friction does not mean a significant reduction of the efficiency of the textile machine. In the case that for strong yarn qualities the tensiometer is maintained in the detection position, even during constant operation new adjustments of the parameters may be carried out, e.g. at the controlled yarn brake, when e.g. the quota of yarn breakages should have increased as a consequence of the above-described influences. In case of a non-controlled yarn brake the tension measured by the tensiometer in the detection position may be used with the help of graphical or numerical displays to manually adapt the braking level of the yarn brake.

The switchable tensiometer, expediently, is associated to a yarn brake operating with an adjustable braking level which remains unchanged during the insertion cycle, in order to vary the braking level until an optimal yarn tension target profile could be found, or is associated to a controlled yarn brake, respectively, which allows to vary the braking effect during one and the same insertion cycle. The timing and/or the braking level of the controlled yarn brake can be adjusted with the help of the information from the tensiometer.

The tensiometer, advantageously, is directly connected to an adjustment device of the yarn brake such that it may operate in a closed regulation loop with feedback. In this case a computerised control device or braking level adjustment device of the yarn brake are expedient which responds to the measured yarn tension in some cases in a correcting fashion.

In a simple embodiment the tensiometer or at least the tensiometer element which actuates the yarn during a measurement can be switched manually or mechanically. A manual switching operation may be carried out by directly engaging at the tensiometer or the element respectively. A mechanical switch over e.g. can be carried out with the help of a spring which automatically adjusts the tensiometer into the passive position after the representative number of insertion cycles has passed.

The tensiometer or the element engaging on the yarn, respectively, expediently is connected with a switch over actuator, preferably an electromagnet or an electric motor which receives the command, e.g. from a timer or a program, to adjust the passive position of the tensiometer after the representative number of insertion cycles had passed.

The handling is very comfortable if the tensiometer is provided with a display device for the measurement results, preferably a display device with a graphical or numerical indication.

Since the tensiometer is permanently provided in the yarn path it is expediently connected to the operation panel of the textile machine such that the tensiometer cannot only be switched over from the operation panel but such that the measurement results can be displayed and in some cases even recorded on the operation panel. In such cases it is expedient if the display already provided on the operation panel also can be used to display the measured yarn tension.

It is expedient to connect the tensiometer to an automatic switch over control device which takes care, e.g. after the representative number of insertion cycles has occurred, that the tensiometer is switched over to the passive position, and which also takes care that the tensiometer is brought in to the respective correct detection position.

In order to minimize the influence of the tensiometer in the detection position for the yarn the tensiometer is structurally combined with the yarn brake, preferably such that the tensiometer uses at least one yarn deflection location of the yarn brake for the measurement.

The tensiometer even may be provided upstream or downstream of a yarn detector, preferably of a weft yarn detector of a weaving machine, and, expediently, even may be structurally combined with the weft yarn detector, preferably such that the tensiometer uses at least one yarn deflection location of the weft yarn detector for the measurement.

Particularly expedient, the tensiometer can be switched into several different detection positions, e.g. depending on the respective yarn quality, which differ from each other e.g. by the respective yarn deflection angle. This is because heavy yarn qualities may need a smaller friction angle for a correct tension measurement than light yarn qualities.

In order to achieve correct measurements despite the different detection positions, it is expedient to provide an electronic measurement evaluation device comprising an automatic compensation circuitry for the different detection positions in order to compensate for the then differing parameters. For the respective detection position at least one position sensor ought to be provided which is connected to the evaluation device. There are namely different force triangles during the measurements in the different detection positions. Those different force triangles would influence the measuring parameters and could falsify the measurements, respectively. The evaluation electronics, however, are able to select the respective correct parameters with the help of the information from the position sensor in order to guarantee correct measurements independent from the respective detection position.

In the case that the yarn processing comprises several yarn channels each of which is supplied by at least one yarn feeding device, expediently one tensiometer is permanently provided in each yarn channel such that it can be switched over, in order to allow the adjustment of the same optimal yarn tension profile for each yarn channel, or even in some cases to adjust an individual optimal yarn tension profile in each yarn channel, respectively.

The invention is applicable to all kinds of weaving machines and knitting machines. A yarn processing system, however, is preferred the textile machine of which is a rapier weaving machine or a projectile weaving machine, although even a jet weaving machine could be provided. In case of knitting machines different machine types could be used like circular knitting machines or flat knitting machines, or the like.

BRIEF DESCRIPTION OF THE DRAWINGS

Embodiments of the object of the invention will be explained with the help of the drawing in which.

DETAILED DESCRIPTION

Figure 1:
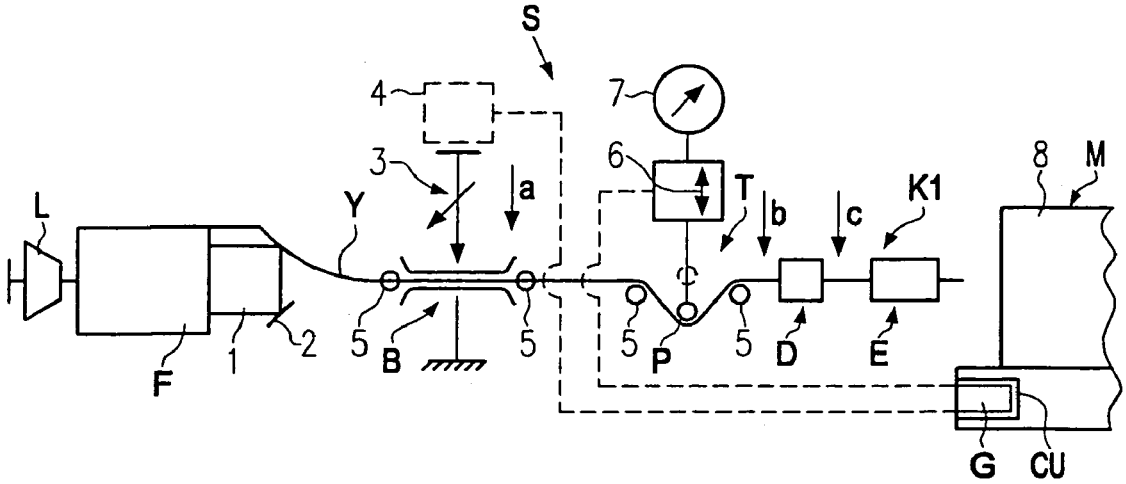
FIG. 1 is a schematic side view of a yarn processing system including a weaving machine.

A yarn processing system S shown in FIG. 1 comprises at least one yarn feeding device F which is associated to a channel Kl of a textile machine M and which supplies the textile machine M with a yarn Y. The yarn Y is taken from a yarn bobbin L, is intermediately stored on a storage body 1 of the yarn feeding device F, and is inserted along a yarn path by an insertion device E into the textile machine M. The textile machine M shown in FIG. 1 is a weaving machine, in particular a projectile weaving machine or a rapier weaving machine, however, but also could be a jet weaving machine. Alternatively, the textile machine even could be a knitting machine.

In the case of a weaving machine as the textile machine M, a yarn brake B, downstream thereof permanently a tensiometer T, downstream thereof in some cases a weft yarn detector D and subsequently the insertion device E are provided in the yarn path downstream of the yarn feeding device F. The yarn Y is inserted into a weaving shed 8 intermittently in insertion cycles determined by a control device CU of the weaving machine by the insertion device E and then is respectively beaten up by a not shown reed. An operation panel having a display G is not shown in detail but belongs to the control device CU of the weaving machine.

In the case of a projectile weaving machine or a rapier weaving machine a withdrawal brake 2 is associated to the storage body 1 of the yarn feeding device F which withdrawal brake 2 generates a predetermined relatively constant basic tension in the yarn Y during withdrawal. In the case of a jet weaving machine no withdrawal brake 2 is provided, but instead a not shown stopping device which provides the length measurement of the weft yarn.

The yarn brake B includes an adjustment device 3 for adjusting the braking level (the braking force), in order to generate during the withdrawal operation a desired yarn tension in the yarn Y between the insertion device E and the yarn brake B. In some cases stationary yarn guiding elements 5 may be provided at the yarn brake B.

FIG. 1 shows in dotted lines a possible alternative of a controlled yarn brake B having a control device 4. This means that the control yarn brake B is activated and deactivated during each insertion cycle by the control device CU, e.g. depending on control signals, in order to vary the braking effect during one and the same insertion cycle and/or to switch between phases with a braking effect and without a braking effect, respectively.

The weft yarn detector D monitors the movement of the withdrawn yarn Y and emits a disturbance signal in the case that in a phase no movement is detected during which phase a movement of the yarn Y is to be expected.

In the case of a rapier weaving machine or a projectile weaving machine the insertion device E includes a yarn selector which selects the respective yarn Y which is to be inserted from one of in some cases several yarn channels and brings the selected yarn to the insertion element which then inserts the yarn into the weaving shed 8, before the yarn is beaten up by the reed and is cut. In the case of a rapier weaving machine the yarn is taken by a bringer gripper at the insertion side end of the weaving shed and then is transported to about the middle of the weaving shed 8, is then transferred to a taker gripper and finally is brought by the taker gripper completely through the weaving shed 8. In a projectile weaving machine a projectile is shot through with each weft yarn. In the case of a jet weaving machine the insertion device E includes at least one main nozzle and in some cases additional nozzles in the weaving shed 8 in order to insert the yarn Y with the help of air jets.

The yarn processing system S is provided with the permanently installed tensiometer T downstream of the yarn brake B. The tensiometer T (or the element P of the tensiometer engaging at the yarn Y) can be switched over between a passive position (in dotted lines) and at least one detection position (in full lines). There is no engagement at the yarn in the passive position. In the detection position the yarn Y is actuated with a deflection and with friction in order to measure the yarn tension. The deflection, e.g., is carried out in relation to the stationary yarn guiding elements 5. The switch over movement is indicated by a double arrow 6. The tensiometer T has an indicator 7 for the measured tension. The yarn tension may be displaced graphically or numerically. Dotted lines indicate that the tensiometer T is connected with the control device CU or the operation panel of the textile machine, respectively. In the latter case, the display G also can be used to indicate the measured tension. Even the setting devices (a keyboard) in the operation panel may be used in order to actuate the tensiometer and to adjust the tensiometer in some cases, respectively.

The tensiometer T may be provided at one of different positions, as indicated by the arrows a, b and c.

The tensiometer T is used to adjust or establish an optimal yarn tension target profile for the insertion cycles (a tension curve over one insertion cycle), which assures the lowest quota of yarn breakages for an optimally high insertion speed in the textile machine.

Figure 5:
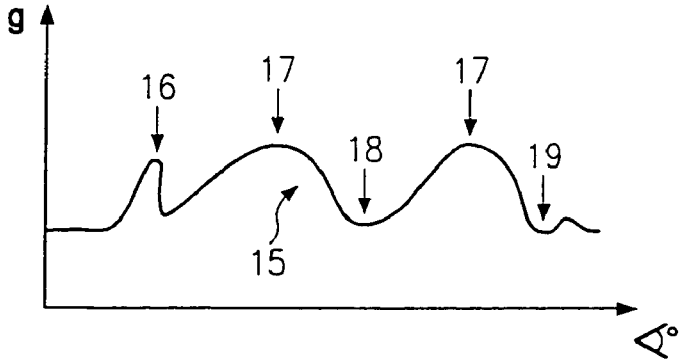
FIG. 5 is a yarn tension target profile.

The yarn tension target profile is shown in FIG. 5 schematically for the example of a rapier weaving machine. The adjustment of a yarn tension target profile inter alia is carried out in case of the first operation or after a change of the processed yarn quality or when the quota of yarn breakages should have increased during operation of the yarn processing system, respectively. The adjustment can be carried out manually at components of the yarn processing system which are decisive for the yarn tension, or even automatically within at least one closed regulation loop with feedback. For an adjustment with the tensiometer brought in to the detection position a sequence of insertions is carried out, typically 50 to 100 insertions, in order to adjust the parameters which influence the yarn tension profile. In the case of a strong yarn Y the tensiometer T remains in the detection position after the adjustment has been carried out. The tensiometer then may in some cases be used further on for the control of the controlled yarn brake B and the like. In the case of weak or delicate yarn material the tensiometer T is switched over to the passive position after the adjustment phase such that the tensiometer does not further on have any influence on the yarn Y. The options to selectively bring the tensiometer or the element P of the tensiometer which acts upon the yarn, respectively, in to the passive position, in case that this is expedient for the processed yarn material, or, to the contrary, to maintain the tensiometer in the detection position if the yarn material can stand the additional friction and the deflection by the tensiometer, are an essential feature of the tensiometer T which per se is permanently provided in the yarn path. In the case that there are several yarn channels at the textile machine M a tensiometer is provided in each yarn channel and such that it can be switched over between a passive position and at least one detection position.

Figure 2:
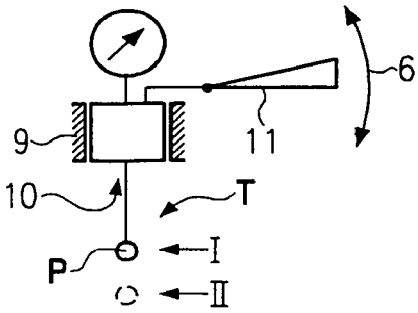
FIG. 2 is a detail as a variant to FIG. 1.

FIG. 2 shows a manually switchable tensiometer T the element P of which engages at the yarn is supported adjustably in a guide 9 and is adjustable back and forth between stops 10 defining the passive position I and one detection position II. A handle 11 e.g. is provided for the switching operation which allows to carry out the adjustments manually by being pivoted in the direction of the double arrow 6. As a not shown alternative the tensiometer may be loaded by a spring in a direction towards the passive position and may be held by a detent mechanism in the detection position. A not shown control device, e.g. a timer or a program, releases the detent mechanism after the representative number of insertion cycles needed for the adjustment such that the tensiometer T then automatically is switched over to the passive position.

Figure 3:
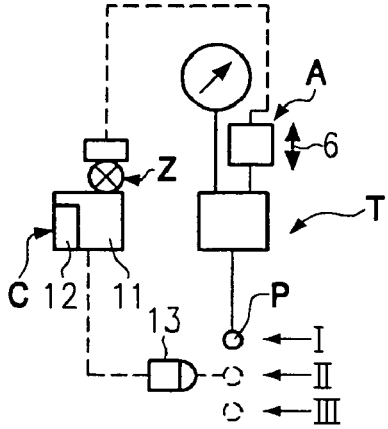
FIG. 3 is a further detail as a variant to FIG. 1.

The tensiometer T shown in FIG. 3 is connected to an actuator A which carries out the switch over movements (double arrow 6). The actuator may be an electromagnet or an electric motor. The tensiometer T in FIG. 3 or the element P engaging on the yarn, respectively, does not have a single detection position II, but has at least one further detection position III. Different yarn deflection angles result in both detection positions II and III. The actuator A may be controlled from an operation panel of the weaving machine in order to adjust the selected detection position, or may be controlled directly at the tensiometer T, respectively, in order to switch the tensiometer T, e.g., back to the passive position I. A timer Z or a program may be provided which take care of the switch over action after the representative number of insertion cycles has been carried out.

FIG. 3 shows a control unit C of the tensiometer T in which an evaluation device 11 for the measurement result (computerized circuitry including a microprocessor) is contained and in some cases, a compensating device 12 for the consideration of the differing force triangles occurring in the different detection positions II and III and to gain respective correct measurement results despite the differing force triangles. The control unit C of the tensiometer may be connected with at least one position sensor 13 which detects the respectively taken detection position II or III and which informs the control device C correspondingly for a compensation.

Figure 4:
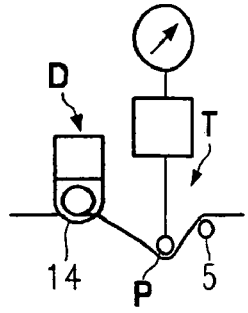
FIG. 4 is a detail as a further variant to FIG. 1.

In order to produce as little additional friction and deflection as possible in the yarn, the tensiometer T may be structurally combined with the yarn brake B or the detector D, respectively. In FIG. 4, e.g., the tensiometer T uses a yarn guiding element 14 of the weft yarn detector D as a stationary deflection location relative to the element P. The yarn guiding element 14 e.g. is a piezoelectric element responding to the yarn motion. A similar structural combination instead could also be provided with the yarn guiding element 5 downstream of the yarn brake B.

A typical yarn tension profile (similar to a heart curve) results from the operation of a rapier weaving machine. FIG. 5 illustrates the yarn tension (in grams g) during an insertion cycle (rotational angle of the main shaft of the weaving machines). The yarn has a predetermined basic tension, generated by the withdrawal brake 2 and by the yarn brake B (in the case that the latter is not a controlled yarn brake but has a basic adjustment of the braking level). After the yarn is taken by the bringer gripper a first relatively sharp rise 16 results in the curve 15. In the subsequent acceleration phase of the bringer gripper the yarn tension rises in the curved part 17 before the yarn tension again is reduced shortly prior to the transfer phase in the middle of the weaving shed during the deceleration of the bringer gripper. At this time (curve part 18) a predetermined yarn tension is obtained with which the yarn is transferred to the taker gripper. This yarn tension is important in order to assure a correct transfer. Subsequently the taker gripper accelerates such that again a curved part 17 with increasing yarn tension occurs, before the yarn tension drops with the deceleration of the taker gripper to a curved part 19. The tension variations shown at 19 result from the beat up movement of the reed and the cutting of the yarn. It is important for the curve which is adjusted during the adjustment procedure that the curve parts 17 are relatively mild and that a certain tension development is achieved with a predetermined basic tension in the curved part 18.

In the detection position the tensiometer T measures the yarn tension downstream of the yarn brake B. Then, with the help of the measurement result or the measurement results of the representative number of insertion cycles, respectively, the withdrawal brake 2 and the yarn brake B, and in some cases, the detector D can be set so that the optimal curve 15 of FIG. 5 results. Those adjustments can be carried out manually or in a closed regulation loop by means of automatic regulating devices which are not shown in detail, e.g. guided by the control device C and/or the control device CU. In this fashion the curve 15 is established. As soon as this has been done the yarn processing system may start the normal operation. In the case of a strong yarn which does not have a tendency to break despite the engagement of the tensiometer, the tensiometer T is kept in the detection position. This allows to monitor the normal operation with the help of measurement results and to carry out, in some cases, further adjustments or optimisations. In the case of a weak yarn, however, the tensiometer T then is switched over to the passive position in order not to influence the yarn further on. If necessary, in case of the occurrence of irregularities or when the quota of yarn breakages increases, or even regularly only for "checking purposes", e.g. with each $100000^{th}$ insertion, the tensiometer T then may be switched over in to the or into one detection position, respectively, in order to then carry out re-adjustments.

The shown tensiometer operates according to the principle of yarn deflection by the element P which is adjusted laterally to the yarn running path and relative to two stationary deflection locations 5. However, also other types of tensiometers may be used, e.g. comprising a piezoelectric element or a pivotable element P. The indicator 7 may be provided directly at the tensiometer. However, alternatively, only the indicator on the display G of the operation panel of the weaving machine could be used, or even both indicators.

For the adjustments e.g. of the withdrawal brake 2 or the yarn brake B, respectively (in some cases also of the detector D), auxiliary devices could be provided which are not shown in detail and which are designed to carry out the adjustments automatically in a closed regulation loop, guided by the measurement result of the tensiometer T.

Although a particular preferred embodiment of the invention has been disclosed in detail for illustrative purposes, it will be recognized that variations or modifications of the disclosed apparatus, including the rearrangement of parts, lie within the scope of the present invention.

The invention claimed is:

1. Yarn processing system, comprising: at least one yarn feeding device associated with a yarn channel, a textile machine, an adjustable yarn brake in a yarn path between the yarn feeding device and the textile machine, and a tensiometer for measuring yarn tension, which tensiometer scans the yarn downstream of the yarn brake, wherein the tensiometer is provided permanently in the yarn path and is switchable between a passive position and at least one detection position, wherein the tensiometer is selectively switchable from the respective detection position into the passive position after a number of insertion cycles has occurred which number is representative for the adjustment of a yarn tension target profile, wherein the tensiometer is connected to an automatic switchover control device in which a timer or a program is provided to determine a duration of use of the detection position, the duration extending only over a selected plurality of consecutive insertion processes.

2. Yarn processing system as in claim 1, wherein the tensiometer is associated either with a yarn brake which has a constant but adjustable braking level during the insertion cycle, or to a yarn brake the braking level of which is controllable during the insertion cycle.

3. Yarn processing system as in claim 1, wherein the tensiometer is connected to a computerized control device or braking level adjustment device of the yarn brake.

4. Yarn processing system as in claim 1, wherein the tensiometer is connected to a switching actuator.

5. Yarn processing system as in claim 4, wherein the switching actuator comprises an electromagnet or an electric motor.

6. Yarn processing system as in claim 1, wherein the tensiometer is provided with an indication device producing a graphical or numerical depiction of measured yarn tension.

7. Yarn processing system as in claim 1, wherein the tensiometer is connected with a display provided on an operation panel of the textile machine.

8. Yarn processing system comprising: at least one yarn feeding device associated with a yarn channel, a textile machine, an adjustable yarn brake in a yarn path between the yarn feeding device and the textile machine, and a tensiometer for measuring yarn tension, which tensiometer scans the yarn downstream of the yarn brake, wherein the tensiometer is provided permanently in the yarn path and is switchable between a passive position and at least one detection position, wherein the tensiometer is selectively switchable from the respective detection position into the passive position after a number of insertion cycles has occurred which number is representative for the adjustment of a yarn tension target profile, wherein the tensiometer is arranged upstream or downstream of a weft yarn detector of the textile machine, and wherein the tensiometer is structurally combined with the weft yarn detector for using at least one yarn deflection location of the weft yarn detector for the measuring of yarn tension.

9. Yarn processing system comprising: at least one yarn feeding device associated with a yarn channel, a textile machine, an adjustable yarn brake in a yarn path between the yarn feeding device and the textile machine, and a tensiometer for measuring yarn tension, which tensiometer scans the yarn downstream of the yarn brake, wherein the tensiometer is provided permanently in the yarn path and is switchable between a passive position and at least one detection position, wherein the tensiometer is selectively switchable from the respective detection position into the passive position after a number of insertion cycles has occurred which number is representative for the adjustment of a yarn tension target profile, wherein the tensiometer is switchable into plural different detection positions which correspond to yarn quality and differ by their respective yarn deflection angles, and wherein an electric measurement evaluation device is provided for the tensiometer, the evaluation device comprising automatic compensation circuitry to provide compensation for measurement parameters associated with the different detection positions, and at least one position sensor is provided for a respective detection position of where the tensiometer engages the yarn during the measurement, the at least one position sensor being connected to the evaluation device.

* * * * *